US006418937B1

(12) United States Patent
Cristiano

(10) Patent No.: US 6,418,937 B1
(45) Date of Patent: Jul. 16, 2002

(54) TOBACCO PIPE ASSEMBLY WITH FILTER ADAPTER

(75) Inventor: Thomas Cristiano, Tampa, FL (US)

(73) Assignee: Cristom Import & Export, Inc., FL (US)

( * ) Notice: Subject to any disclaimer, the term of this patent is extended or adjusted under 35 U.S.C. 154(b) by 0 days.

(21) Appl. No.: 09/552,964

(22) Filed: Apr. 20, 2000

Related U.S. Application Data

(60) Provisional application No. 60/130,866, filed on Apr. 23, 1999.

(51) Int. Cl.[7] ..... A24F 1/02; A24F 7/00; A24F 1/08

(52) U.S. Cl. ..... 131/215.2; 131/216; 131/227; 131/199

(58) Field of Search ..... 131/329, 330, 131/200, 201, 202, 203, 204, 205, 206, 228, 215.1, 215.2, 216, 199, 227, 220, 229

(56) References Cited

U.S. PATENT DOCUMENTS

| | | | | |
|---|---|---|---|---|
| 415,690 | A | * | 11/1889 | Wuterich |
| 748,729 | A | * | 1/1904 | Hauser |
| 959,649 | A | * | 5/1910 | Thomson |
| 1,312,490 | A | * | 8/1919 | McAuliffe |
| 1,418,113 | A | * | 5/1922 | Wawricka |
| 1,733,113 | A | * | 10/1929 | Bigoney |
| 2,189,684 | A | * | 2/1940 | Sprinkel |
| 2,205,553 | A | * | 6/1940 | Blair |
| 2,345,676 | A | * | 4/1944 | Klugherz |
| 2,628,622 | A | * | 2/1953 | Smith |
| 2,654,370 | A | * | 10/1953 | Smith |
| 2,737,187 | A | * | 3/1956 | Kokkinos |
| 2,933,091 | A | * | 4/1960 | Ostergard |
| 2,963,024 | A | * | 12/1960 | Lichtstern et al. |
| 3,079,928 | A | * | 3/1963 | Jensen |
| 3,128,776 | A | * | 4/1964 | Bigelow |
| 3,463,167 | A | * | 8/1969 | Kubert et al. |
| 3,601,131 | A | * | 8/1971 | Reggio |
| 4,340,071 | A | * | 7/1982 | Smith |
| 4,549,558 | A | * | 10/1985 | Gregory |
| 4,687,005 | A | * | 8/1987 | Moore |
| 4,870,979 | A | * | 10/1989 | Browning et al. |

FOREIGN PATENT DOCUMENTS

| | | | |
|---|---|---|---|
| AT | 176696 | * | 4/1953 |
| CA | 529515 | * | 8/1956 |
| GB | 1404 | * | 1/1884 |
| GB | 10987 | * | 4/1895 |
| GB | 7493 | * | 2/1906 |

* cited by examiner

*Primary Examiner*—Jose Fortuna
*Assistant Examiner*—Carlos Lopez
(74) *Attorney, Agent, or Firm*—Gerald E. Hespos; Anthony J. Casella

(57) ABSTRACT

A pipe assembly is provided to accommodate the specific filter preferences of the pipe smoker. The pipe assembly includes a bowl, a stem and a mouthpiece. A cylindrical mounting aperture extends into the end of the stem remote from the bowl, and a connecting passage joins the mounting aperture to the tobacco receiving cavity in the bowl. The mouthpiece has a proximal end with a passage therein and a distal end that can be slidably received in the mounting aperture of the stem. The mouthpiece further includes a filter receptacle that communicates with the passage extending into the proximal end of the mouthpiece. The filter receptacle is dimensioned to accommodate wide prior art filters. The pipe assembly further includes a tubular filter adapter with an outside diameter for slidable engagement in the filter receptacle and an inside diameter dimensioned to receive narrower pipe filters. A tubular plug is provided to fill outer circumferential regions of the filter receptacle to provide a substantially uniformly dimensioned smoke passage for smokers who prefer no filter at all.

5 Claims, 3 Drawing Sheets

TOBACCO PIPE ASSEMBLY WITH FILTER ADAPTER

This application claims the benefit of U.S. Provisional Patent Appl. No. 60/130,866 filed Apr. 23, 1999.

BACKGROUND OF THE INVENTION

1. Field of the Invention

The subject invention relates to a tobacco pipe configured to accommodate any of several types of filters.

2. Description of the Related Art

A prior art tobacco pipe typically includes a bowl having an open-topped cavity for receiving a small volume of tobacco. A stem extends from the bowl and includes a passage that communicates with the bottom end of the cavity formed in the bowl. A cylindrical mounting aperture extends into the end of the stem opposite the bowl and communicates with the passage between the stem and the tobacco cavity in the bowl. The bowl and the stem of most prior art pipes are of unitary construction.

The typical prior art pipe also includes a mouthpiece having a flattened proximal end configured for engagement in the mouth of a smoker and a cylindrical distal end configured to be frictionally retained in the cylindrical mounting aperture at the end of the stem remote from the bowl. The mouthpiece includes its own passage extending axially therethrough to provide smoke communication from the bowl to the proximal end of the mouthpiece.

The bowl and the stem of prior art pipes typically are made from wood, ceramic or an ivory-like material. This part of the pipe will last virtually forever with reasonable care. The mouthpieces of most prior art pipes currently are made of plastic, and can become worn or cracked. Mouthpieces, therefore are made separable from the stem by slightly pulling and twisting the mouthpiece relative to the stem and bowl.

Pipes vary widely in price, and there are many manufacturers of pipes in each price range. Most pipe smokers have a collection of pipes, and the pipe purchasing decision is dictated largely by the price of the pipe and the aesthetic appeal of the pipe to the smoker. Pipe collections of most smokers will include pipes from several different manufacturers.

Many prior art pipes include a hollow receptacle in the stem, in the mouth piece or partly in the stem and the mouthpiece for accommodating a filter. The filter is positioned in the pipe by first separating the mouthpiece from the stem and then slidably inserting the filter into the filter receptacle. The mouthpiece and the stem then are re-engaged frictionally with one another. Filters are changed periodically by merely separating the mouthpiece from the stem, sliding the used filter from the pipe, inserting a new filter and reconnecting the mouthpiece to the stem.

Pipe filters are of many different internal constructions that reflect the various design theories and proprietary positions assumed by the filter manufacturers. For example, some prior art filters comprise helically wound arrays of filter paper through which the smoke must pass. Other filters include a cylindrical outer tube of hard paperboard or plastic with perforated end caps. An array of loose filtering crystals then are trapped in the outer tube. Smoke must pass through the end caps, and into communication with the filtering crystals. Still other filters are formed from an elongate piece of a soft absorbent wood with sides having longitudinally extending grooves to maximize surface area.

In addition to different constructions, pipe filters are of different dimensions. For example, some filters are relatively short wide cylinders, while others are relative long narrow cylinders, and still others have dimensions between these extremes. FIGS. 1–8 illustrate several prior art filters. For example, a first prior art filter is identified generally by the numeral 11 in FIGS. 1 and 2. The first prior art filter 11 is formed from a generally cylindrical roll of wound filter paper having a plastic outer layer applied thereto. The first prior art filter 11 is substantially cylindrical, and defines a length $L_1$, and a width $W_1$ that typically is about 9 mm.

A second prior art filter is identified generally by the numeral 12 in FIGS. 3 and 4. The second prior art filter 12 also is substantially cylindrical and comprises a substantially rigid outer tube with opposed end caps. As shown most clearly in FIG. 4, the end caps are perforated to permit air and smoke to flow therethrough. Interior portions of the second prior art filter 12 are filled with a plurality of filtering crystals. The second prior art filter 12 defines a length $L_2$ substantially equal to the length $L_1$ of the first prior art filter 11. The second prior art filter 12 further defines a width $W_2$ substantially equal to the width $W_1$ of the first prior art filter 11.

A third prior art filter is identified by the numeral 13 in FIGS. 5 and 6. The third prior art filter 13 has a construction similar to the first prior art filter 11. However, the third prior art filter 13 has a length $L_3$, as shown in FIG. 5, that is substantially greater than the length $L_1$ of the first filter 11. As shown in FIG. 6, the third prior art filter 13 has a width $W_3$ that is substantially less than the width $W_1$ of the first prior art filter 11. The width $W_3$ typically is about 6 mm.

A fourth prior art filter is identified by the numeral 14 in FIGS. 7 and 8. The fourth prior art filter 14 is formed, from a soft wood, such as balsa wood, and has a length $L_4$ which typically is equal to or slightly less than the length $L_3$ of the third prior art filter 13 but greater than the length $L_1$ of the first prior art filter 11. The fourth prior art filter is not cylindrical as in the first through third prior art filters 11–13. Rather, as shown most clearly in FIG. 8, the fourth prior art filter has a substantially cross-shape and defines a maximum width W4 which is approximately equal to the width W3 of the third prior art filter 13.

The different dimensions of pipe filters evolved over time to match the dimensions of filter receptacles employed by the different manufacturers of pipes. The dimensions of the pipe cavities used by different manufacturers are dictated by several parameters, including the tooling used by each manufacture, theories regarding the effectiveness of different filter sizes and the tendency of manufacturers to adhere to customs developed and used over a long time. Some pipe manufacturers produce their own filters to dimensionally match filter receptacles in their pipes. In these situations, there is no incentive for the pipe manufacturer to dimensionally change their filter receptacle to accommodate the filter of another company. In other situations, pipe manufacturers and filter manufacturers are separate, but have longstanding business relationships and are supportive of one another. In these situations, there is no incentive for either the pipe manufacturer or the filter manufacturer to change the filter dimensions.

In view of the above, no prior art pipes can accept all commercially available filters. However, as noted above, most pipe smokers have a collection of pipes from different manufacturers. Thus, most pipe smokers will need a corresponding collection of pipe filters. This creates various inventory management and control problems for the pipe smoker. Specifically, most pipe smokers will have to keep a collection of pipe filter types equal in number to the number of different pipe brands in the pipe smokers collection.

Many pipe smokers develop a preference for a particular type of filter. For example, some pipe smokers prefer wound paper filters, others prefer filters with filtering crystals, while still other prefer a soft wood filter. Other pipe smokers perceive a difference in draw between a long narrow filter and a short wide filter. Thus, a pipe smoker's filter preference often is compromised by the physical dimensions of the filter receptacle in various pipes. A smoker may have to choose a less preferable filter to smoke a more preferable pipe, or a less preferable pipe to utilize a more preferable filter.

Some pipe filter cavities are of roughly equal length but different cross-sectional sizes. In these situations, a smaller filter can be placed in the larger cavity. However, the effectiveness of the smaller filter is substantially reduced because the smoke will follow the less resistive path around the filter. Additionally, a small filter will tend to rattle within a large filter cavity each time smoke is drawn through the pipe.

To further complicate matters, many pipe smokers prefer no filter at all. However, the dimensions of the pipe filter receptacle can affect the way smoke flows through the stem and mouthpiece when a filter is not present. For example, a filter receptacle intended for a short wide filter creates turbulence in the smoke flow when that filter is removed.

In view of the above, it is an object of the subject invention to minimize filter inventory control problems for pipe smokers.

It is another object of the subject invention to enable a pipe smoker to utilize any of a plurality of filter types and dimensions.

SUMMARY OF THE INVENTION

The subject invention is directed to a pipe having a bowl, a stem and a mouthpiece. The stem and the mouthpiece of the pipe are constructed to define a generally cylindrical filter receptacle therein. The cylindrical filter receptacle has a diameter substantially equal to the diameter of the widest commercially available filter. Additionally, the cylindrical filter receptacle has a length substantially equal to the longest of the largest commercially available filter.

The subject pipe assembly further includes at least one substantially cylindrical tubular adapter. The adapter has an outside diameter substantially equal to the inside diameter of the filter receptacle. Additionally, the adapter has an inside diameter substantially equal to the outside diameter of the narrowest commercially available filter. Thus, the adapter can be used to securely position a long narrow filter in a filter receptacle that is cross-sectionally dimensioned for a short wide filter.

The pipe assembly may further include a filterless adapter plug intended for smokers who prefer to use no filter at all. The filterless adapter plug is a generally cylindrical tube having an inside diameter substantially equal to the inside diameter of portions of the smoke passage extending from the bowl to the mounting aperture of the stem and substantially equal to portions of the passage extending from the proximal end of the mouthpiece to the filter receptacle. The filterless adapter plug may define an outside diameter substantially equal to the inside diameter of the filter receptacle. Thus, the filterless adapter plug can be securely retained in the filter receptacle and provides a substantially uniformly dimensioned smoke passage extending from the bowl through the mouthpiece.

The pipe assembly of the subject invention may be sold with an integral bowl and stem and with a mouthpiece frictionally retained in the end of the stem remote from the bowl. The pipe assembly may further be sold with at least one adapter. The pipe owner can use the pipe with a wide commercially available filter and no adapter. Alternatively, the pipe owner can use the pipe with a narrower commercially available filter and with the adapter. A smoker who prefers no filter can install the adapter plug that enables a smoke passage of substantially uniform dimensions. In most situations, the pipe owner will not have to change adapters throughout the life of the pipe. However, if the pipe smoker's filter preference changes, the adapters may be removed and/or replaced to accommodate filter preferences.

DETAILED DESCRIPTION OF THE PREFERRED EMBODIMENTS

Figure 1:
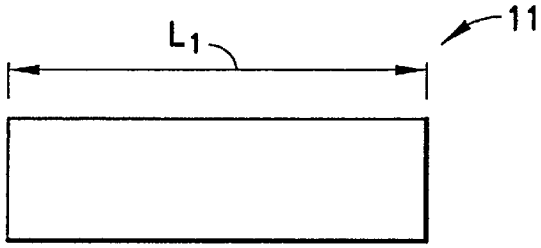
FIG.1 PRIOR ART
FIG. 1 is a side elevational view of a first prior art pipe filter.
Figure 2:
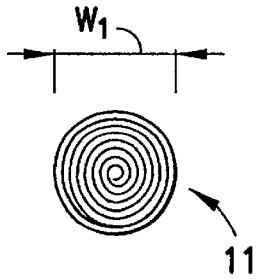
FIG.2 PRIOR ART
FIG. 2 is an end elevational view of the filter shown in FIG. 1.
Figure 3:
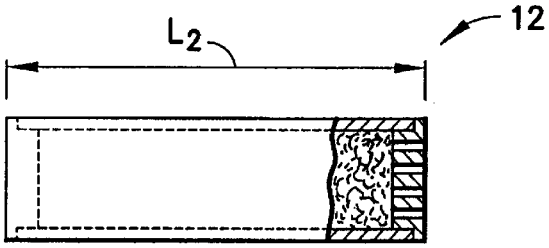
FIG.3 PRIOR ART
FIG. 3 is a side elevational view of a second prior art pipe filter.
Figure 4:
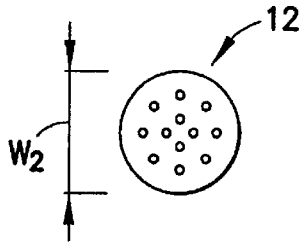
FIG.4 PRIOR ART
FIG. 4 is an end elevational view of the prior art pipe filter shown in FIG. 3.
Figure 5:
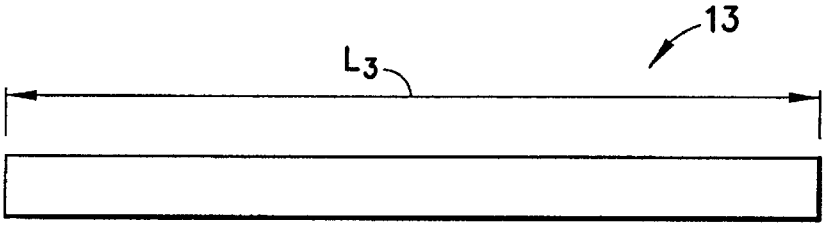
FIG.5 PRIOR ART
FIG. 5 is a side elevational view of a third prior art pipe filter.
Figure 6:
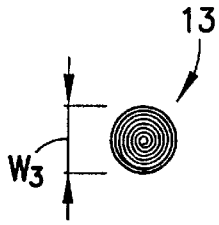
FIG.6 PRIOR ART
FIG. 6 is an end elevational view of the prior art pipe filter shown in FIG. 5.
Figure 7:
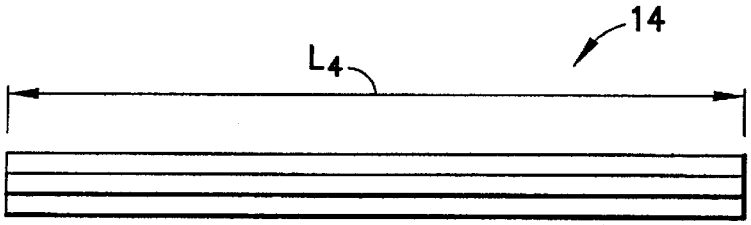
FIG.7 PRIOR ART
FIG. 7 is a side elevational view of a fourth prior art pipe filter.
Figure 8:
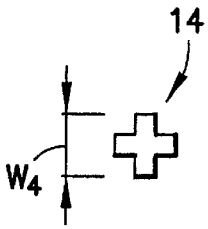
FIG.8 PRIOR ART
FIG. 8 is an end elevational view of the prior art pipe filter shown in FIG. 7.
Figure 9:
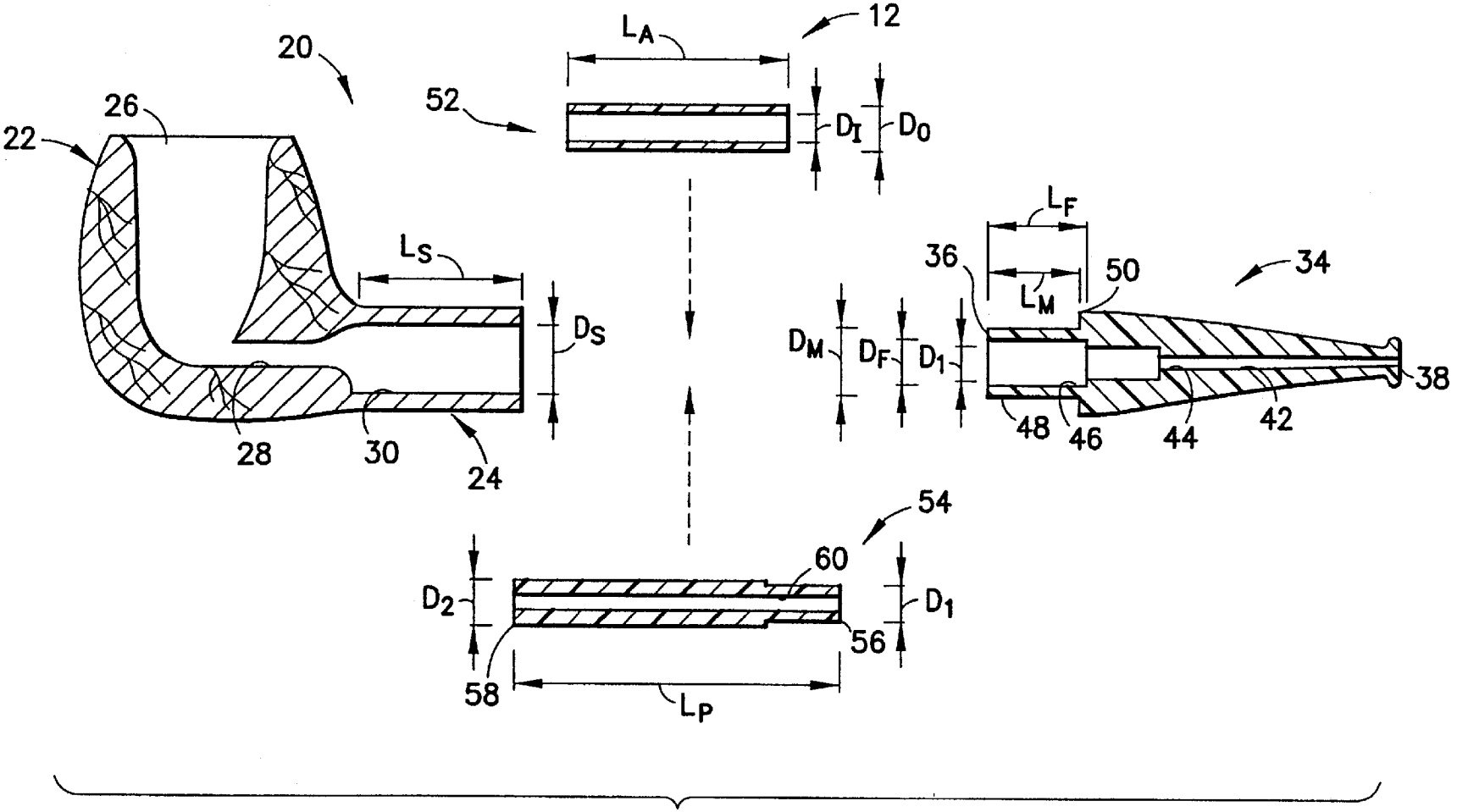
FIG. 9 is an exploded cross-sectional view of a pipe bowl, stem and mouthpiece assembly along with a filter adapter and a filterless adapter plug in accordance with the subject invention.

A pipe assembly in accordance with the subject invention is identified generally by the numeral 20 in FIG. 9. The pipe assembly 20 includes a bowl 22 and a stem 24 extending unitarily from the bowl 22. The bowl 22 includes an open-top tobacco receiving cavity 26. A passage 28 extends from a bottom portion of the tobacco receptacle 26. A cylindrical mounting aperture 30 extends into the end of the stem 24 remote from the bowl 22 and communicates with the passage 28. The cylindrical mounting aperture 30 in the stem 24 defines a length $L_s$ and a diameter Ds. The diameter $D_s$ of the large diameter passage 32 in the pipe stem 24 is greater than the widths $W_1$–$W_2$ of the prior art filters 11 and 12.

The pipe 20 further includes a mouthpiece 34. The mouthpiece 34 is an elongate structure having a substantially cylindrically generated distal end 36 and a substantially flattened proximal end 38. A lip 40 extends about the periphery of the proximal end 38, as in the prior art, to facilitate retention of the mount piece 34 in the mouth of a smoker. A passage 42 extends continuously from the proximal end 38 toward the distal end 36 of the mouthpiece 34. The passage 42 has a cross-sectional area approximately equal to or slightly smaller than the cross-sectional area of the passage 28 extending from the tobacco receiving cavity 26 of the bowl 22. A stepped filter receptacle 46 extends from the proximal portion 44 of the passage 42 to the distal end 36 of the mouthpiece 36. The stepped filter receptacle 46 is a substantially stepped cylinder and defines a major diameter $D_f$ and a length $L_f$. The major diameter $D_f$ of the filter receptacle 46 is proximally equal to the width $W_1$ of the first prior art filter 11 and the width $W_2$ of the second prior art filter 12, and hence is approximately 9 mm. The length $L_f$ of the major diameter portion of the filter receptacle 46 is less than the lengths $L_1$–$L_4$ of all of the prior art filters 11–14. A minor diameter portion of the receptacle 46 is adjacent the passage 42 and has a diameter $D_1$ equal to the diameter $W_3$ and $W_4$ of the prior art filters 13 and 14.

A mounting cylinder 48 is defined at the distal end 36 of the mouthpiece 34. The mounting cylinder 48 has an outside diameter $D_m$ and a length $L_m$. The outside diameter $D_m$ of the mounting cylinder 48 is approximately equal to the inside diameter $D_s$ of the mounting aperture 30 extending into the stem 24. Additionally, the length $L_m$ of the mounting cylinder 48 is significantly less than the length $L_s$ of the mounting aperture 30 extending into the stem 24. A step 50 extends outwardly from the proximal end of the mounting cylinder 48 to limit telescoped engagement of the mouthpiece 34 into the stem 24.

The pipe assembly 20 further include a generally cylindrical tubular filter adapter 52. The filter adapter has a length $L_a$ slightly less than the length $L_4$ of the fourth prior art filter 14. The filter adapter 52 further defines an outside diameter $D_o$ approximately equal to or slightly less than the inside diameter $D_f$ of the filter receptacle 46 in the mouthpiece 34, and hence equal to or slightly less than 9 mm. Additionally, the filter adapter 52 defines an inside diameter $D_i$ approximately equal to or slightly greater than the widths $W_3$ and $W_4$ of the third and fourth prior art filters 13 and 14 respectfully, and thus equal to or slightly greater than 6 mm. With this construction, the adapter 52 can be received slidably in the 9 mm wide filter receptacle 46 and can slidably receive the prior art 6 mm wide filter 13 or 14 therein.

The pipe assembly 20 further includes a tubular filterless adapter plug 54. The tubular filterless adapter plug 54 includes opposed first and second ends 56 and 58 which defines a length $L_p$ approximately equal to the length $L_3$ or $L_4$ of the prior art filters 13 and 14. A narrow cylindrical passage 60 extends continuously through the tubular plug 54 from the first end 56 to the second end 58. The passage 60 defines a cross-sectional area approximately equal to the area of the passage 42 near the proximal end 38 of the mouthpiece 34 and approximately equal to the area of passage 30 extending from the bowl 22 into the stem 24. Portions of the tubular filterless adapter plug 54 adjacent the first end 56 define an outside diameter $D_1$ which is approximately equal to the minor inside diameter $D_1$ of the filter receptacle 46 in the mouthpiece 34, which, as noted above, is about 6 mm. Additionally, portions of the tubular filterless adapter plug 54 adjacent the second end 58 define an outside diameter $D_2$ which is greater than the outside diameter $D_1$ and approximately equal to the major inside diameter $D_f$ of the passage 46 extending into the mouthpiece 34. Thus, the outside diameter $D_2$ of the filterless adapter plug is about 9 mm.

Figure 10:
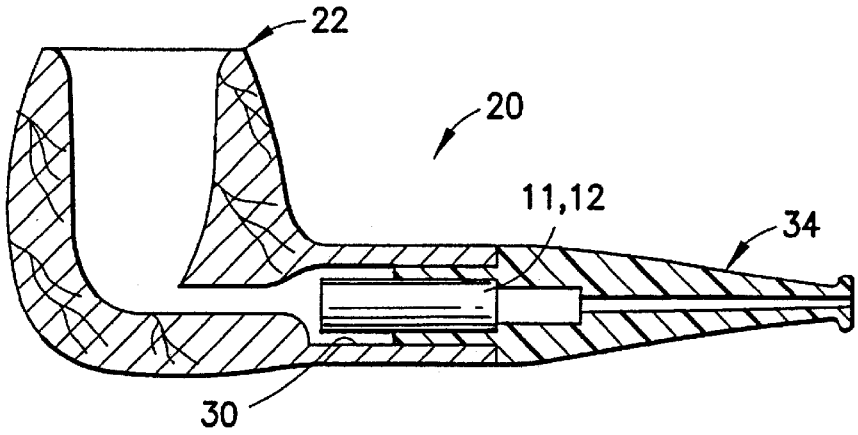
FIG. 10 is a cross-sectional view showing the pipe with the prior art filter of FIGS. 1 or 3.

The pipe assembly 20 can be used with any of the prior art filters 11–14. In particular the filter receptacle 46 has an inside diameter $D_f$ of about 9 mm which is approximately equal to or slightly greater than the outside widths $W_1$ and $W_2$ of the first and second prior art filters 11 and 12. Additionally, the filter receptacle 46 has a length $L_f$ slightly less than the lengths $L_1$ and $L_2$ of the first and second prior art filters 11 and 12. Thus, either of the first and second prior art filters 11 and 12 can be slidably inserted into the filter receptacle 46 of the mouthpiece 34 with a sufficiently tight fit to ensure that all smoke flowing from the bowl 22 will pass through the prior art filter 11 or 12, as shown in FIG. 10. Additionally, the length $L_f$ of the filter receptacle 46 ensures that either prior art filter 11 or 12 will project distally beyond the mouthpiece 34, thereby ensuring easy replacement.

Figure 11:
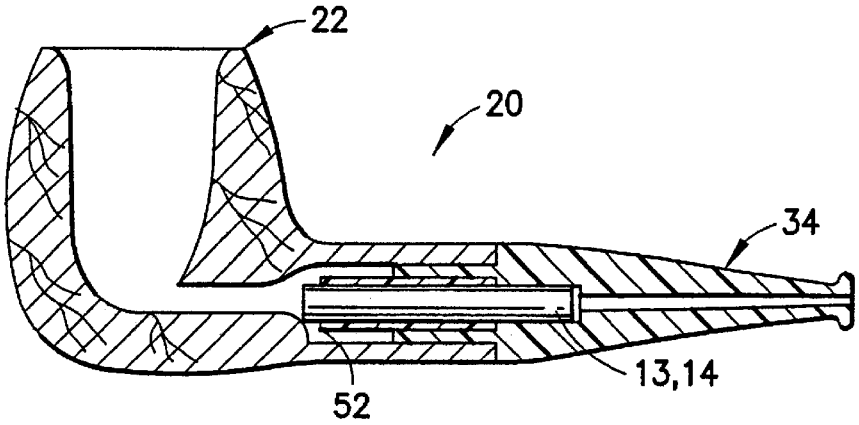
FIG. 11 is a cross-sectional view showing the pipe with the filter adapter of FIG. 9 and the prior art filter of FIGS. 5 or 7.

Alternatively, the pipe assembly 20 can be used with the filter adapter 52 and either of the third or fourth prior art filters 13 or 14, as shown in FIG. 11. In particular, the filter adapter 52 defines an outside diameter $D_o$ of about 9 mm which is approximately equal to the inside diameter $D_f$ of the filter receptacle 46. Furthermore, the filter adapter 52 defines a length $L_a$ greater than the length $L_f$ of the large diameter portion of the filter receptacle 46 in the mouthpiece, but slightly less than the length $L_3$ or $L_4$ of the prior art filters 13 or 14 respectively. Thus, the filter adapter 52 can be received slidably in the large diameter portions filter receptacle 46, such that an end of the tubular filter adapter 52 will project distally beyond the mouthpiece 34. The inside diameter $D_i$ of the tubular filter adapter 52 is about 6 mm which is approximately equal to or slightly greater than the widths $W_3$ and $W_4$ of the respective third and fourth prior art filters 13 and 14. Thus, either of the third and fourth prior art filters 13 and 14 can be inserted slidably within the filter adapter 52. The length $L_a$ of the filter adapter 52 is less than the length $L_3$ or $L_4$ of either the third or fourth prior art filters 13 and 14. Thus, either the third or fourth prior art filter 13 or 14 will project distally beyond the filter adapter 52 and will extend substantially to the connecting passage 28 that extends from the bowl 22 to the stem 24. The filter adapter 52 enables either of the third or fourth prior art filters 13 or 14 to be securely but removably retained within the pipe assembly 20. Furthermore, the relative length dimensions of the third and fourth prior art filters 13 and 14 relative to the length $L_a$ of the filter adapter 52 enable easy replacement of either the third or fourth prior art filter 13 or 14.

Figure 12:
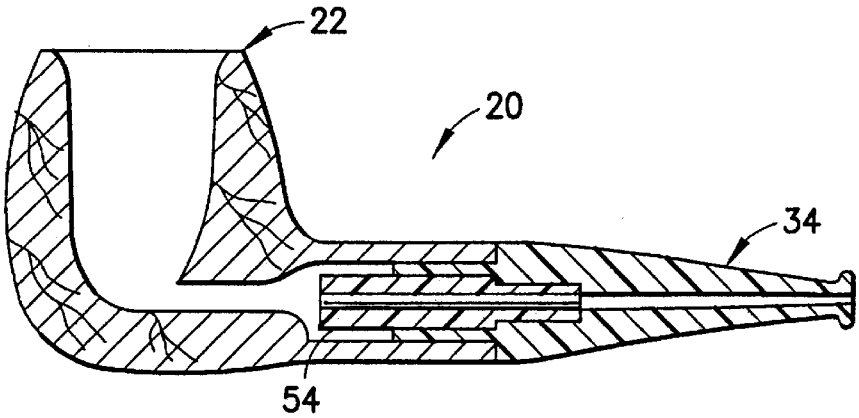
FIG. 12 is a cross-sectional view showing the pipe with the filterless adapter plug of FIG. 9.

The tubular filterless adapter plug 54 can be used as shown in FIG. 12 with the pipe assembly 20 by smokers who prefer no filter at all. More particularly, portions of the tubular filterless adapter plug 54 adjacent the first end 56 thereof can be received slidably within the minor diameter portions of the filter receptacle 46 of the mouthpiece 34. Portions of the tubular plug 54 adjacent the second end 58 thereof will extend through the major diameter portions of the receptacle 46, and will lie substantially adjacent the passage 28 extending from the bowl 22. Accordingly, a substantially constant diameter passage will extend from the bowl 22 to the proximal end of the mouthpiece 34 to provide a smooth continuous draw for smokers who prefer no filter at all.

While the invention has been described with respect to certain preferred embodiments, it is apparent that various changes can be made without departing from the scope of the invention as defined by the appended claims.

What is claimed is:

1. A pipe assembly for use selectively with a first filter having a first width and a first length or a second filter having a second width and a second length, said pipe assembly comprising a bowl having a tobacco receiving cavity therein, a stem extending from the bowl, a cylindrical mounting aperture extending into an end of the stem remote from the bowl, a passage extending from the mounting aperture to the tobacco receiving cavity in the bowl, a mouthpiece having opposed proximal and distal ends, the distal end of the mouthpiece being dimensioned to be slidably received within the mounting aperture of the stem, a mouthpiece passage extending from the proximal end of the mouthpiece toward the distal end, a filter receptacle extending into the distal end of the mouthpiece and communicating with the mouthpiece passage, the filter receptacle defining an inside diameter substantially equal to the first width and a length less than the first length, a substantially cylindrical tubular filter adapter having an outside diameter substantially equal to the inside diameter of the filter receptacle and having an inside diameter substantially equal to the second width, whereby the first filter can be securely retained in the filter receptacle, and whereby the second filter can be securely retained within the filter adapter while the filter adapter is securely retained in the filter receptacle.

2. The pipe assembly of claim 1, wherein the filter adapter defines a length less than the second length.

3. The pipe assembly of claim 2, wherein the filter adapter defines a length greater than the length of the filter receptacle.

4. The pipe assembly of claim 3, further comprising a substantially tubular plug having opposed first and second ends, portions of the tubular plug in proximity to the first end defining an outside diameter substantially equal to the inside diameter of the filter receptacle and inserting said plug into said filter receptacle.

5. The pipe assembly of claim 4, wherein the tubular plug includes an outwardly extending flange between the opposed first and second ends thereof, the outwardly extending flange defining an outside diameter greater than the inside diameter of the filter receptacle, such that said flange limits insertion of said tubular plug into said filter receptacle.

* * * * *